US006053804A

United States Patent [19]

Parulski

[11] Patent Number: 6,053,804

[45] Date of Patent: Apr. 25, 2000

[54] GRINDER ATTACHMENT FOR PRECISION GRINDING MACHINES

[75] Inventor: Timothy M. Parulski, Meadville, Pa.

[73] Assignee: Channellock, Inc., Meadville, Pa.

[21] Appl. No.: 09/116,670

[22] Filed: Jul. 16, 1998

[51] Int. Cl.[7] ..... B24B 1/00

[52] U.S. Cl. ..... 451/415

[58] Field of Search ..... 451/415, 65, 363, 451/294

[56] References Cited

U.S. PATENT DOCUMENTS

| | | | |
|---|---|---|---|
| 3,711,998 | 1/1973 | Mason | 51/166 MH |
| 3,783,561 | 1/1974 | Fortunski | 51/134.5 R |
| 4,090,331 | 5/1978 | Kobayashi et al. | 51/134.5 R |
| 4,384,432 | 5/1983 | Gerner | 51/134.5 R |
| 4,536,993 | 8/1985 | Shimizu et al. | 51/165.8 |
| 4,953,325 | 9/1990 | Unser | 51/95 TG |
| 4,987,703 | 1/1991 | Brill | 51/166 R |
| 4,989,376 | 2/1991 | Armond et al. | 51/165.71 |
| 5,018,309 | 5/1991 | Wyss | 51/72 R |
| 5,112,281 | 5/1992 | Minato et al. | 474/84 |
| 5,462,470 | 10/1995 | Oda et al. | 451/294 |
| 5,607,368 | 3/1997 | Hida et al. | 474/110 |
| 5,718,614 | 2/1998 | Armond et al. | 451/5 |

*Primary Examiner*—Joseph J. Hail, III
*Assistant Examiner*—Dermott J. Cooke
*Attorney, Agent, or Firm*—Lackenbach Siegel Marzullo Aronson & Greenspan, P.C.

[57] ABSTRACT

A grinder attachment for precision grinding with an existing grinding machine having an external housing and a driven shaft rotatable about a grinding machine axis at a predetermined rotational speed when energized includes a driving pulley wheel having a first diameter attachable on the driven shaft for rotation therewith about the machine axis. The attachment to the housing is rigidly attached to the external housing of the grinding machine to substantially prevent any movements of the attachment housing in a three-dimensional space relative to the external housing in the grinding machine. A spindle is rotatably mounted on the attachment housing. A driven pulley wheel is fixedly mounted on a spindle to rotate with the spindle, a grinding abrasive element being mounted on the spindle at a grinding station for rotation therewith. Pulleys are mechanically coupled to cause rotation of the driven pulley when the driving pulley is rotated by the grinding machine. The pulley wheels have different diameters so that actuation of the grinding machine causes the abrasive elements to only rotate relative to the external housing at a selected different speed from the predetermined rotational speed for precision grinding in the grinding station.

19 Claims, 6 Drawing Sheets

GRINDER ATTACHMENT FOR PRECISION GRINDING MACHINES

BACKGROUND OF THE INVENTION

1. Field of the Invention

The present invention generally relates to power tools, and, more specifically, to a grinder attachments for existing precision grinding machines.

2. Description of the Prior Art

Grinding machines may be classified as cylindrical, internal, centerless, surface and special grinders, based on the general character of the work. Each of these classes may be further subdivided according to special characteristics either of work or machine. For example, surface grinding machines may include a horizontal spindle or a vertical spindle and may vary from small tool-room machines, using 7 by ½ in. wheels, to massive face grinding machines using 48 and even 60 in. diameter chucks.

The work is supported on tables, equipped with either hand or power feed. The spindles are driven either directly from the motor or through belt drives.

Face grinders are a form of surface grinder in which the work travels past the side of a wheel, carried on a horizontal spindle mounted at right angles to the line of travel of the work The wheel grinds the vertical surface of the work at right angles to the surface of the table. The table is traversed hydraulically, and the wheel is driven by silent chain or V belt. Work can be held by bolting to the table or to angle plates or by magnetic chucks. These machines are used for surface grinding and for the grinding of machine knives, shear blades, etc. Tables range from 22 to 27 in. wide and from 60 to 168 in. long.

Grinding tolerances have decreased with improvements in grinding machines, grinding wheels and gauging devices. On cylindrical grinding machines, for example, tolerances in diameter of ±0.00001 in. are possible when an automatic sizing device similar to a Nortonizer (Norton Co.) is used, if the machine and temperature conditions approach ideal. In out-of-roundness and taper, tolerances as small as 0.00005 in. are practical. Readily held tolerances, however, range from around ±0.0001 in. to 0.0005 in., with the surface finish as fine as 4 to 5 micro inches rms. While other operations, such as honing and lapping, may be used to refine the grinding of cylindrical surfaces and produce exceedingly smooth and highly accurate surfaces, it is sometimes desired to provide grinding with relative tight tolerances. While such tolerances may readily be achieved with a high quality fixed grinder, such as an Okamoto grinder, loss of precision may easily result when attachments are connected to the grinder for converting the speed of rotation of the grinder spindle from the nominal to a different rotational speed. In some cases, because of the nature of the grinding operation, a higher rotational speed of the abrasive grinding element is required. While an attachment has been known for connection to an existing fixed grinding machine for converting the rotational speed of the grinder, typically enhancing or increasing the operating speed of the abrasive element the known grinder attachment, sold by Speedline Industries, Inc., of Clinton Township, Mo., has not been useful for precision grinding operations. The known grinder attachment was made of cast aluminum, and deformed under stress. Also, the means for securing the attachment to the fixed grinder has not prevented the attachment from moving relative to the fixed grinder housing or head. Because of both of these reasons, the abrasive grinding element mounted on the attachment has been subjected to excessive vibrations, movements and deflections relative to the fixed grinder head. These movements do not permit precision grinding at high tolerances.

SUMMARY OF THE INVENTION

An object of the present invention is to provide a grinder attachment that does not have the disadvantages inherent in such known attachments.

It is another object of the present invention to provide a grinder attachment which is simple in construction and economical to manufacture.

It is still another object of the present invention to provide a grinder attachment which is easy and convenient to attach to an existing grinder.

It is yet another object of the present invention to provide a grinder attachment as in the previous objects which is sufficient rigid so as not to deform under normal use, thereby helping to maintain close tolerances during precision grinding.

It is still another object of the present invention to provide a grinder attachment of the type under discussion which includes suitable securing means for rigidly connecting the attachment housing to the external housing or head of the grinding machine to substantially prevent any linear and/or angular movements of the attachment housing in the three dimensional space relative to the grinding head of the grinding machine.

It is an additional object of the present invention to provide such a grinding machine, as suggested in the previous objects, which further includes a tensioning pulley for selectively tensioning the belt that mechanically links a driving pulley of the grinder attachment to a driven pulley on which the abrasive grinding element is mounted, to prevent slipping of the belt on the pulleys during grinding operations.

In order to achieve the above objects, as well as other which will become apparent hereinafter, a grinder attachment in accordance with the present invention for precision grinding with an existing grinding machine having an external housing and a driven shaft rotatable about a grinder and a machine axis at a predetermined rotational speed when energized comprises a driving pulley wheel having a first diameter attachable on the driven shaft for rotation therewith about a machine axis. An attachment housing is provided, and attachment means is provided for rigidly attaching said attachment housing to the external housing of the grinding machine to substantially prevent any movements of said attachment housing in the three dimensional space relative to the external housing of the grinding machine. A spindle is provided which is rotatably mounted on said attachment housing. A driven pulley wheel is fixedly mounted on said spindle to rotate with said spindle. A abrasive grinding element is provided mounted on said spindle at a grinding station for rotation therewith. Coupling means is provided for mechanically coupling said pulley wheels to cause rotation of said driven pulley wheel when the driving pulley wheel is rotated by the grinding machine, said pulley wheels having different diameters. In this manner, actuation of the grinding machine causes an abrasive element to only rotate relative to said external housing of said grinding machine at a selected different speed from said predetermined rotational speed for precision grinding at said grinding station.

A BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein.

DESCRIPTION OF A PREFERRED EMBODIMENT

Figure 1:
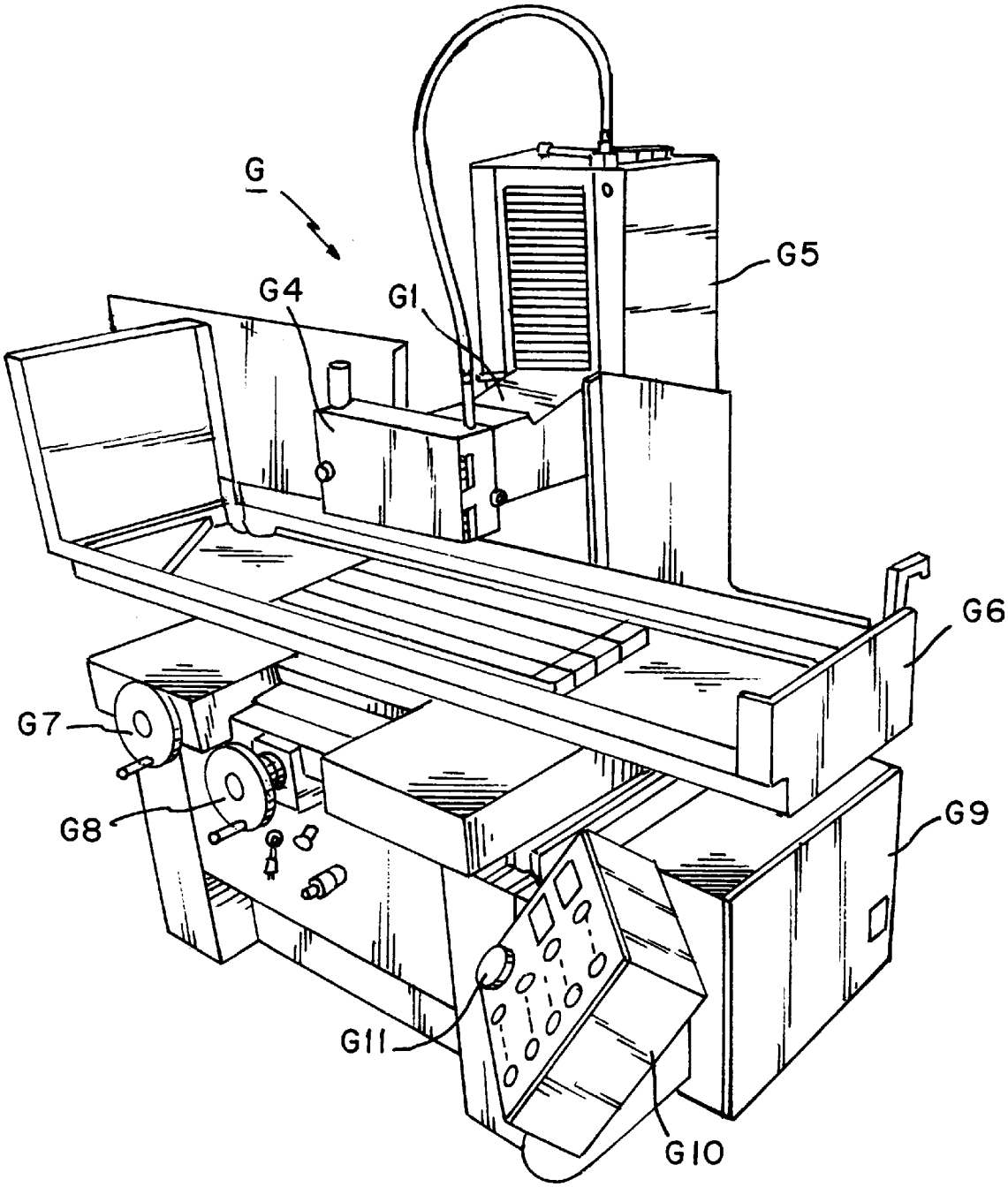
FIG. 1 is a perspective view of a grinding machine of the type with which the grinder attachment of the present invention may be used.
Figure 2:
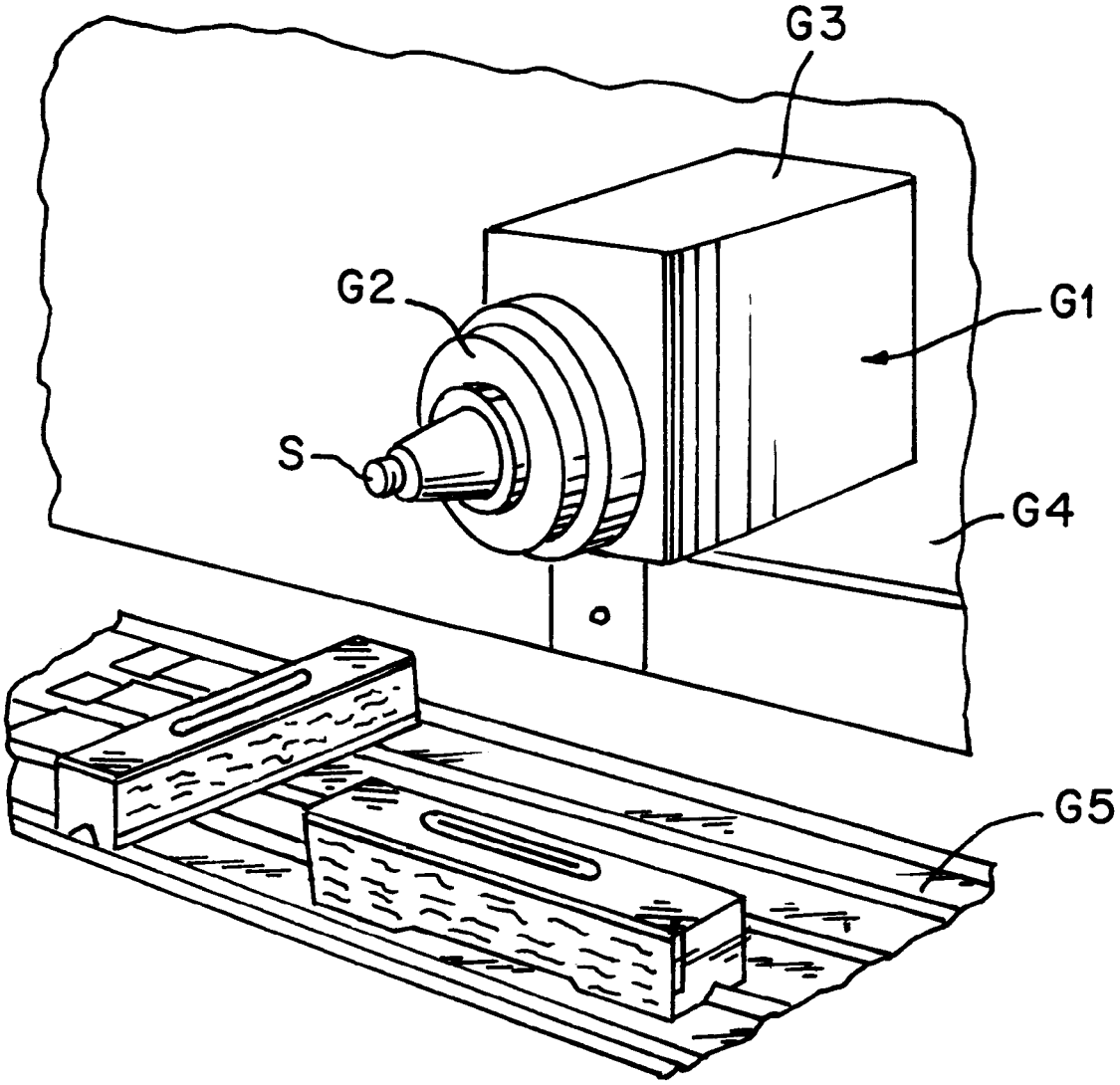
FIG. 2 is an enlarged perspective view of the grinding wheel head of the grinding machine shown in FIG. 1.

Referring now specifically to the figures, in which identical or similar parts are designated by the same reference numerals throughout, and first referring to FIG. 1, a precision grinding machine is generally designated by the reference numeral G. Referring specifically to FIG. 2, the grinding machine includes a drive shaft S rotatably mounted on a grinding wheel head G1 on which there is provided a circular collar G2 through which the drive shaft S extends. In the specific grinder illustrated, which is an Okamoto grinder model No. PFG-618, the grinding head G1 is provided with a generally flat horizontal surface G3 which is useful in stabilizing the grinder attachment, as will be described hereinafter. It will be clear to those skilled in the art that different grinding machines may have different grinding head configurations and the grinder attachment may need to be modified in order to achieve the objectives of the invention.

In FIG. 1, the circular collar G2 is covered by a grinding wheel guard G4 which can be removed to gain access to the circular collar G2 and drive shaft S.

Figure 3:
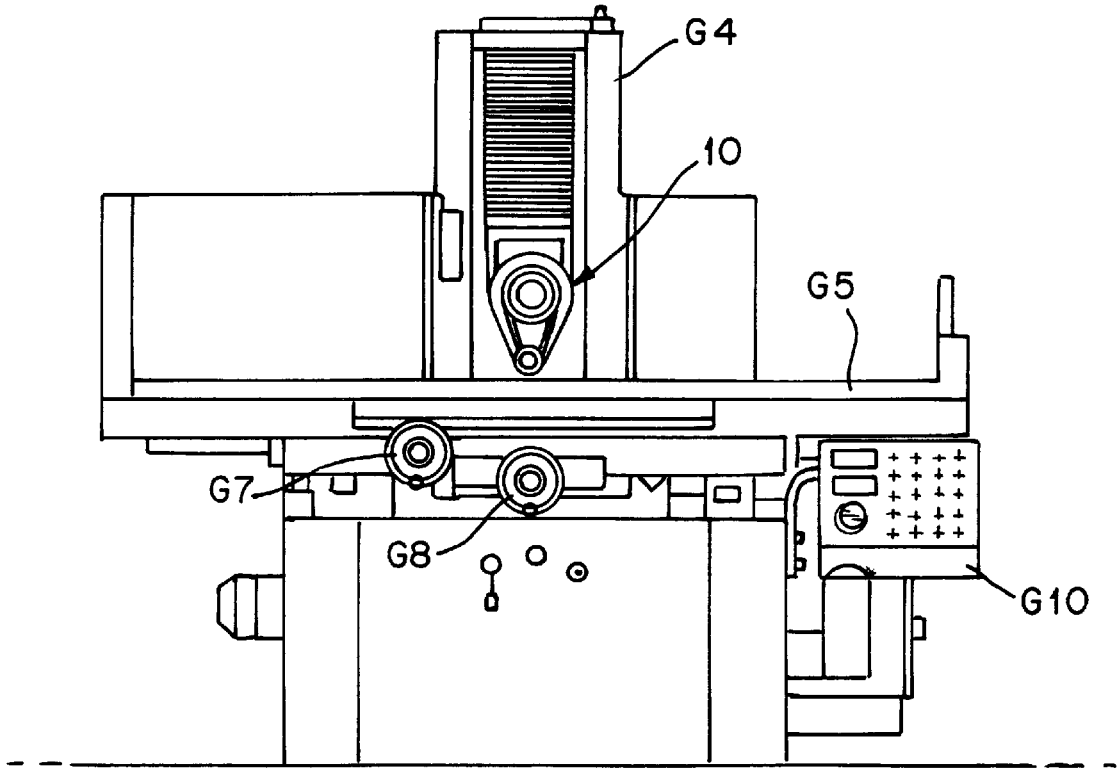
FIG. 3 is a front elevational view of the grinding machine shown in FIG. 1, with the speed converter grinding attachment mounted on the grinding head.

Adjustability is provided by a column G5 which can be used to raise or lower the grinding head G1 in relation to a table G6. Adjustability is provided by table hand wheel G7 and a cross feed hand wheel G8. Adjustment can be affected automatically ny means of electric power box G9 and operation control panel G10 which may include, for example, a vertical feed control G11. In FIG. 3, the grinding wheel guard G4 shown removed and the speed converter grinding attachment 10 is shown mounted on the grinding wheel head G1. The detail of the attachment 10 will now be more specifically described in relation to FIGS. 4–6.

The grinder 10 is intended for use in precision grinding and special grinding applications where high grinding speeds are required. The grinder attachment 10 is intended, therefore, to be connected to or mounted on the head G1 an existing grinding machine, shown in dash outline in FIG. 5.

In precision grinding, it is clear that the achievable tolerances are a function of the stability of the grinding element in relation to the work. Any factors which destabilize the grinding element, such as instability in the support for the grinder, excessive play in the bearings rotatably supporting the grinding element, etc., will possibly result in excessive wobble or vibration of the grinding element, this decreasing or deteriorating the level of tolerances that can be achieved. It will be clear, therefore, that the basic grinder used in conjunction with the attachment of the invention will have certain inherent tolerances. The grinder attachment of the present invention cannot normally improve the levels of tolerance achievable with the grinding machine to which it is attached. However, it is an objective of the present invention to maintain, as closely as possible, the nominal tolerances specified by the grinding machine manufacturer and introduce little, if any, instability, while increasing or decreasing the nominal rotational speeds of the grinding machine.

Typically, the grinding machine head G1 and the circular collar typically define a grinder or machine axis $A_m$. At one axial end of the external housing or head G1 the collar G2 fixes the bearings through which a grinding machine shaft S is rotatably supported. Since the instabilities of the grinding element may occur in any of the directions of a three dimensional space, the grinder attachment 10 is designed to rigidly secure the attachment to the grinding head G1 of the grinding machine so as to substantially eliminate any degrees of freedom of linear and rotational movements in any of the three dimensions of the three dimensional space in relation to the external housing G1. By preventing relative movements of the grinding attachment 10 in relation to the head or external housing G1, one significant source of instability is elimataed.

The grinder attachment 10 includes a driving pulley 12 having a first diameter $D_1$ attachable to the driven shaft S for rotation therewith about the machine axis $A_m$. The driven pulley 12 is mounted for rotation in a plane P1 (FIG. 2).

Figure 4:
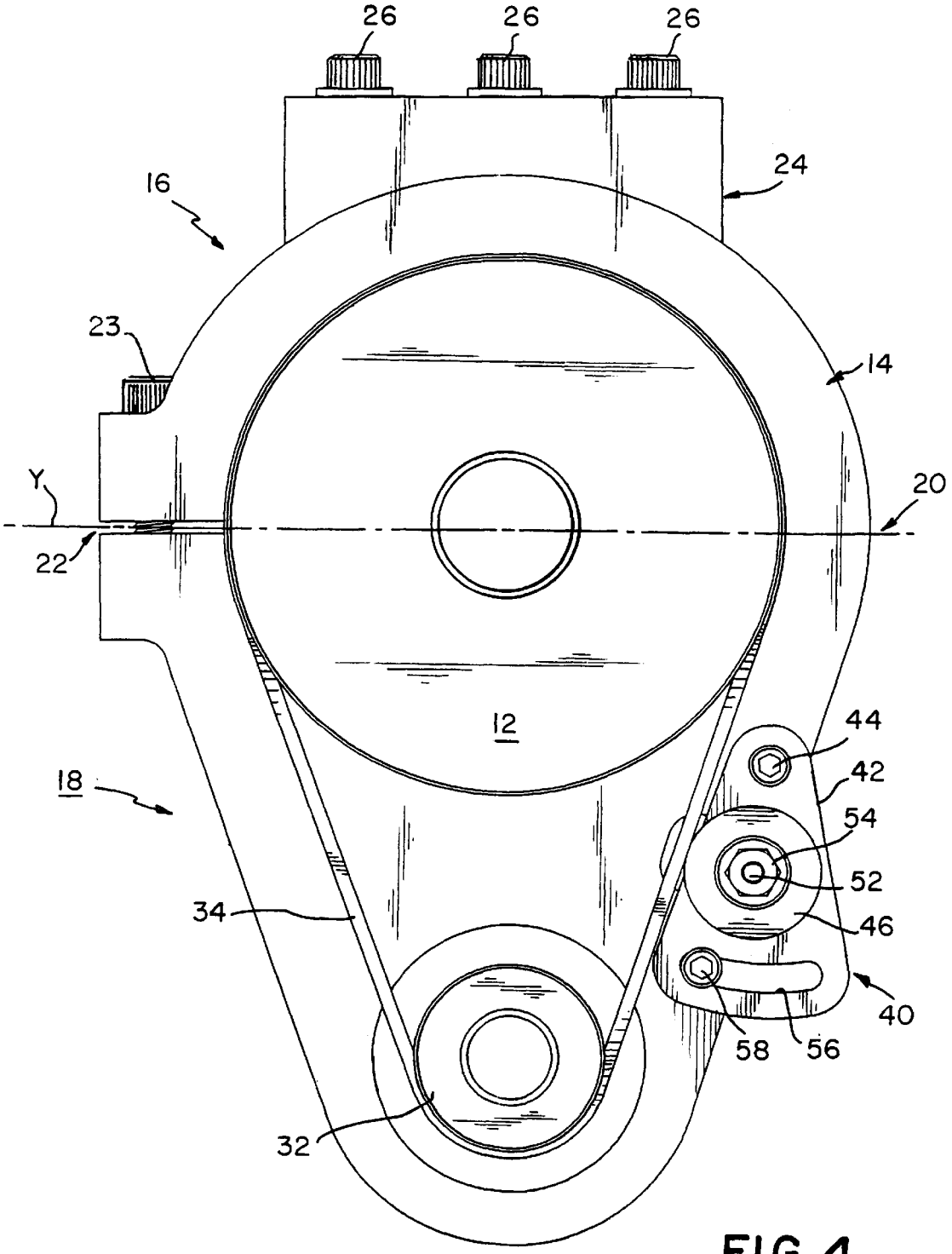
FIG. 4 is a front elevational view of the grinder attachment in accordance with the present invention.

The grinder attachment 10 includes attachment housing 14 which, as best shown in FIG. 4, includes an upper clamping portion 16 which generally has a circular configuration above the plane Y, the internal diameter of which is selected to conform to the external diameter of collar G2 of the head G1 of the grinding machine so that it can be clamped thereto. The circular configuration of the upper portion 16 generally conforms to the cylindrical shape or configuration of many grinding machine collars G2. However, it will be evident that if the attachment 10 is to be used in conjunction with a grinding machine that has a square or other collar configuration at the axial end thereof proximate to shaft S, the upper or clamping portion 16 will need to be modified to conform to the external shape of the grinding machine head so that when the attachment 10 is secured to the head it will provide maximum contact and stability in relation to the housing. Similarly, the diameter defined by the upper clamping portion 16 will necessarily be different for different sized grinders, having different collars G2 of different diameters.

The attachment housing 14 also includes, as best shown in FIG. 4, a lower generally V-shaped bearing support portion 18, below plane Y in FIG. 4, which is integrally formed with the upper clamping portion 16 on one side at 20 while at the diametrically opposite side there is formed a gap or space 22 between the portions 16, 18, the size of which is adjustable by means of a clamping bolt 23. Once the attachment housing 10 has been placed on the collar G2, tightening of the bolt 23 closes the space or gap 22 to tighten and secure the attachment housing 10 to the grinder head G1. Once the bolt 23 has been sufficiently tightened on the collar G2, the attachment housing eliminates degrees of freedom of movement of the housing in relation to the external housing G1 at least in the linear direction of the grinder axis $A_m$, as well as linear directions within a plane substantially parallel to plane P1. However, without additional measures, the attachment housing 10 can still pivot about the generally circular collar G2 for pivoting or rotational movements about the grinder axis $A_m$. In order to eliminate the possibility of such pivoting or rotation about the grinder axis, a grinder attachment stabilizing plate 24 is provided, which is secured to the upper clamping portion 16 by means of suitable fasteners, such as bolts 26, and is also fastened to the top surface G3 of the grinder head G1 by means of suitable fasteners, such as bolts 26'. Preferably, the bolts 26' can replace existing bolts in the grinder. However, if necessary, additional threaded holes may be formed in the external housing G1 to accept the bolts 26'. It will be clear that the grinding attachment stabilizing plate 24 prevents pivoting or rotational movements of the grinder attachment 10 about the machine axis $A_m$ so that the grinder attachment housing 12 becomes rigidly secured to the grinder head and, for all practical purposes, cannot and does not move relative thereto. Accordingly, the attachment housing 10 does not practically introduce any additional movements or instabilities beyond those that are already present or inherent in the underlying grinder.

In order to minimize or totally eliminate instabilities introduced by the attachment housing 14, as aforementioned, it will also be clear that the attachment housing must be formed of a material and be so configured that it does not introduce or exhibit any appreciable deformations during use which would introduce undesired instabilities. Accordingly, the material from which the attachment housing 14 is formed must itself be very rigid or stiff. It has been found that steel is a suitable material for such a housing. However, other materials can also be used if they are sufficiently stiff or rigid, such as cast iron. Depending on the material used, it will be evident to those skilled in the art that the dimensions of the housing need also be suitably selected so as to minimize noticeable deformations in the shape of the housing 14.

The purpose of the grinder attachment is to provide precision grinding at a speed other than the nominal speed of the underlying grinding machine G. As such, there is provided at the lower end of the V-shaped support portion 18 a bearing housing 28 (FIG. 5) which supports a high quality bearing (not shown) which supports a spindle 30 for rotational movement while introducing very little instability into the spindle. Therefore, the bearing must be a high performance bearing, having small short or spindle deflections such as 0.0002 in to 0.0004 in. It will be evident that the ultimate instability of the grinding element will reflect the instabilities introduced by both the attachment housing 14 as well as the instabilities introduced by the spindle supporting bearing. Accordingly, both of these factors must be minimized in order to achieve the objects of the present invention namely, to minimize or substantially eliminate any instabilities introduced by the use of the grinder attachment 10 of the present invention. The total instability introduced by the attachment cannot be less than the greatest instability introduced by any one factor or condition. Therefore, it either the attachment housing 10 is unstable or if the spindle-supporting bearing renders the spindle unstable, the overall stability of the grinding element mounted on the spindle 30 will not exhibit the desired stability and will introduce a deterioration in the tolerances, which may be unacceptable for a given precision grinding application Mounted on the spindle 30 is a driven pulley 32 which is arranged to rotate about a grinding axis $A_g$ (FIG. 5) substantially in the plane P1 of the driving pulley 12. It will be evident, however, to those skilled in the art that the pulleys 12, 32 need not necessarily be in the same or common plane and may, in fact, be arranged in different planes as long as these pulleys are mechanically coupled or linked in a suitable manner to transmit power from one to the other. In the embodiment illustrated, the pulleys 12, 32 are coupled or linked by a flat drive belt 34. In its broadest applications, however, it will also be evident that the pulleys 12, 32 may be replaced by gears or other driving and driven elements. In fact, the driving and the driven pulleys may be directly coupled or engaged, as with a planetary or epicyclic gearing. Also, the use of bevel gears, for example, may be used to change the orientations of the driving and driven elements.

Figure 5:
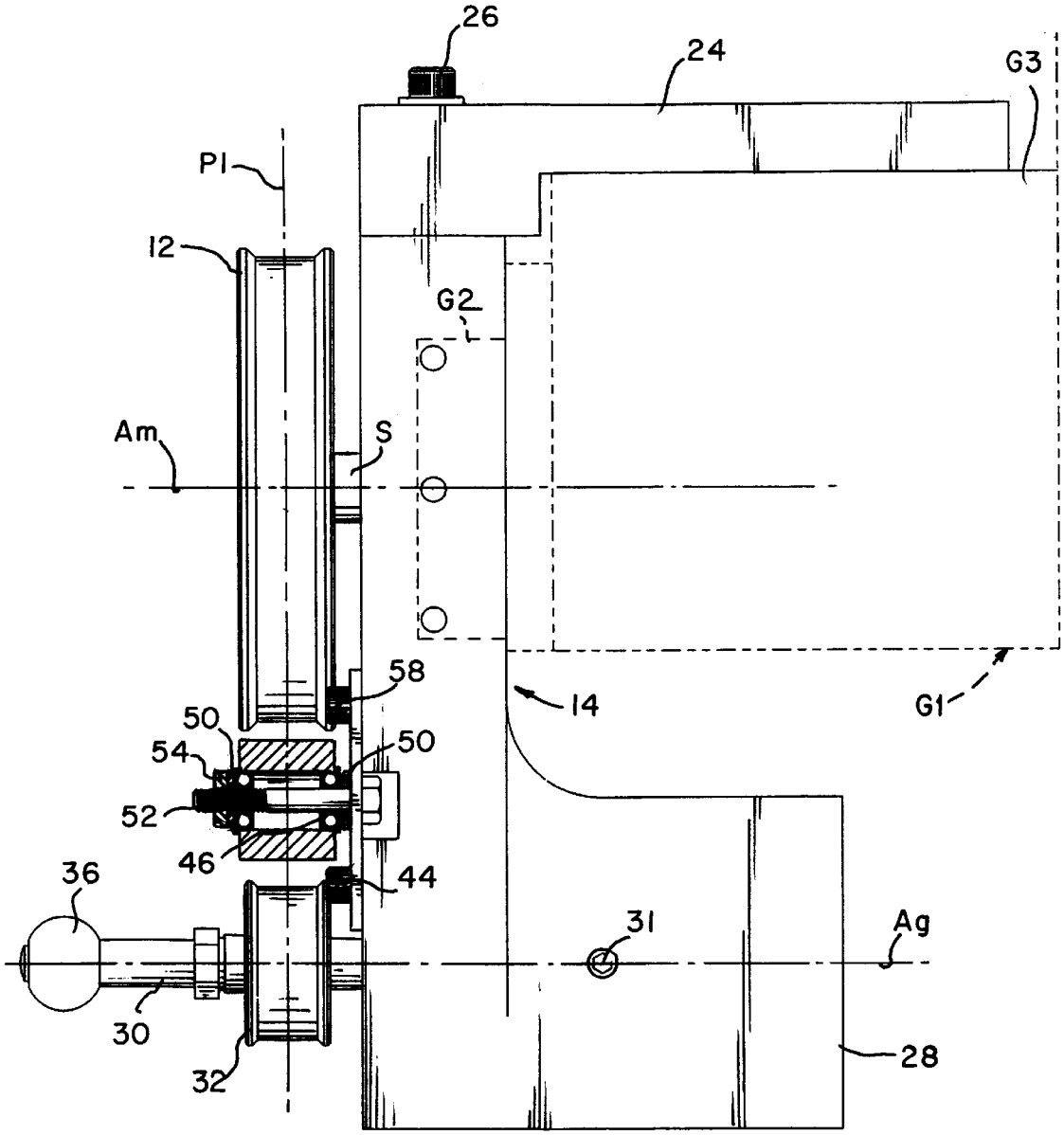
FIG. 5 is a side elevational view of the grinder attachment shown in FIG. 4.
Figure 6:
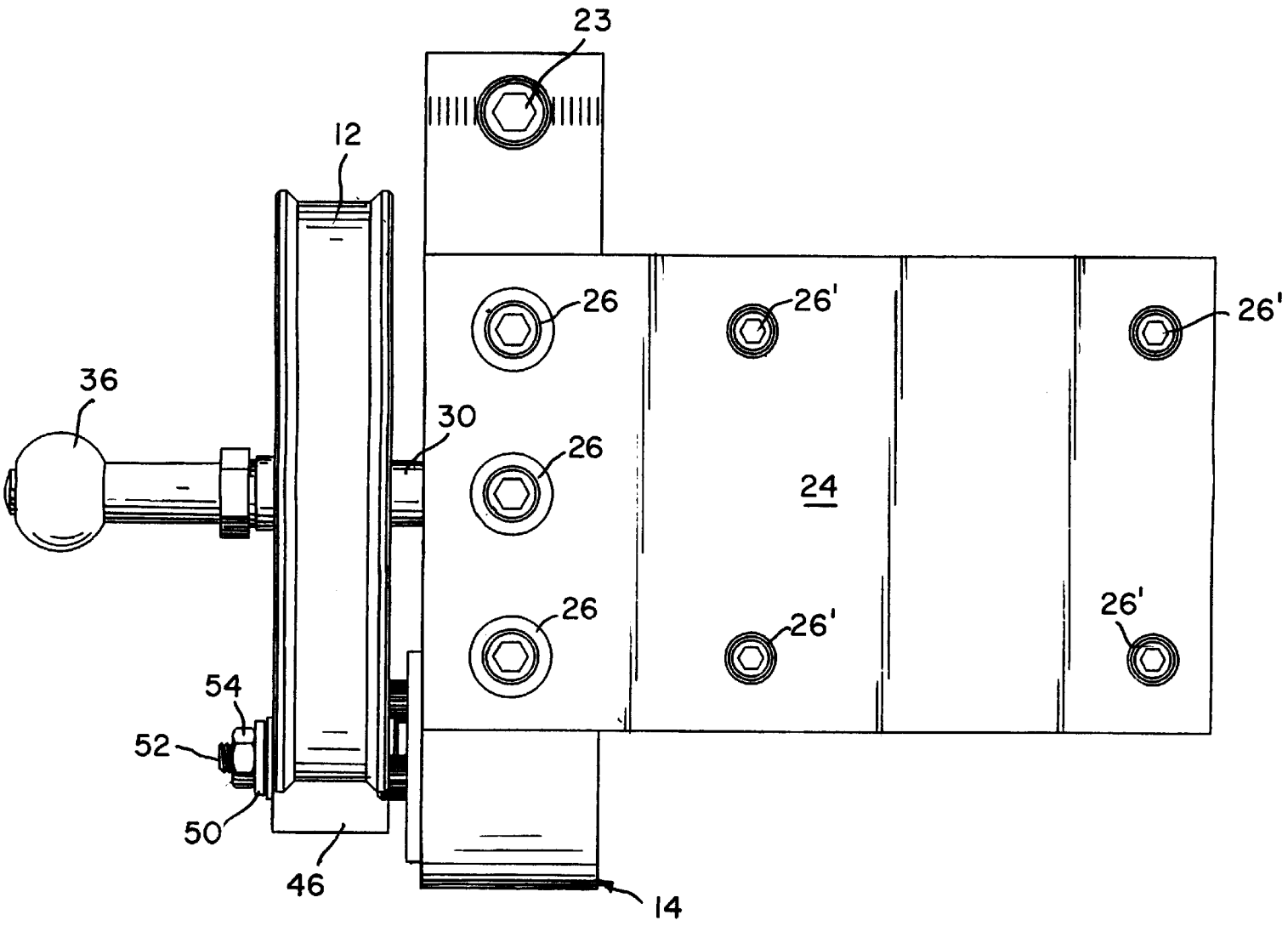
FIG. 6 is a top elevational view of the grinder attachment shown in FIGS. 4 and 5.

In the embodiment illustrated, the mode of power transmitted by the driving pulley 12 to the driven pulley 32 causes the spindle 30 to rotate about the axis $A_g$, which is mounted in a suitable bearing as aforementioned. A set screw 31 may be used to fix the bearing within the bearing support housing portion 28, as best shown in FIG. 5.

Mounted at the free end of the spindle 30 is a abrasive grinding element 36, the specific shape or configuration of which is not critical for purposes of the present invention. The abrasive element 36 may be secured to the spindle 30 in any suitable or conventional manner.

It should be evident to those skilled in the art, therefore, that by stabilizing the bearing within the bearing support housing portion 28 in relation to the head G1, and by stabilizing the spindle 30 in relation to the attachment housing 14, the grinding attachment 10 in accordance with the present invention can substantially or mostly eliminate the introduction of any additional instabilities above the ones that are inherently present within the grinding machine G.

While the preferred embodiment illustrates a driving pulley 12 having a larger diameter $D_1$ and a driven pulley 32 having a smaller diameter $D_2$, which increases or enhances the grinding speed of the underlying grinding machine, it will also be evident to those skilled in the art that where the opposite result is desired, namely, a decrease in the grinding speed, this can be readily achieved by reversing the diameters and selecting a diameter $D_2$ for the driven pulley 30 which is greater than the diameter of the driving pulley 12. Of course, if the nominal rotational speed of the underlying grinding machine is suitable for a given application, then there may be no need to use the grinding attachment at all. However, this attachment can be used to advantage if the grinding requirements are such that the nominal grinding speed of the underlying grinding machine must either be increased or decreased, while maintaining the inherent grinding tolerances provided by the base grinding machine.

Another feature of the invention is the provision of a tensioning mechanism 40 (FIG. 4) which can increase the tension in the 34 belt drive to avoid slipping of the belt in relation to one or both of the pulleys 12, 32, during a grinding operation. Normally, when the belt 34 has sufficient tension in it, the mechanism 40 is in the position shown in FIG. 1, in which it does not engage the belt. The mechanism 40 includes a bracket 42 which is pivotally mounted about a suitable pivot pin and such as a bolt 44. A tensioning roller 46 is rotatably mounted, by means of bearings 46 and washers 50 on a suitable shaft, shown in FIG. 2 as being a bolt 52. A nut 54 secures the tensioning roller assembly on the bolt 52. Prior to engagement with the tensioning mechanism 40, the belt 34 assumes a predetermined path between the pulleys 12, 32, as best shown in FIG. 1. The diameter of the tensioning pulley 46 is selected such that when the bracket is moved to its fully counterclockwise position, the tensioning pulley 46 does not engage or contact the drive belt 34. However, as the tensioning bracket is rotated or pivoted in a clockwise direction, the tensioning pulley increasingly presses against the drive belt and deflects it inwardly to effectively increase the path of movement of the belt or stretches the drive belt so that it applies increased tensions on the driving and driven pulleys. This reduces the possibility of slipping between the belt and the pulleys. In order to lock the position of the tensioning bracket 42 in a desired position, to provide a selected amount of tension on the drive belt, there is provided an arcuate slot 56 through which a locking bolt 58 extends and is adjustably mounted, and which can lock the angular position of the bracket 42 in a desired position. The housing 14, however, is made sufficiently rigid so that it maintaines its mechanical integrity not withstanding the increased tension in the belt 32 and the corresponding forces applied to the housing by means of the pulleys.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims.

What I claim is:

1. A grinder attachment for precision grinding with an existing grinding machine having an external housing and a driven shaft rotatable about a grinder machine axis at a predetermined rotational speed when energized, the attachment comprising a driving pulley wheel having a first diameter attachable on the driven shaft for rotation therewith about the machine axis; an attachment housing; a stabilizing member for rigidly attaching said attachment housing to the external housing of the grinding machine to substantially prevent any movements of said attachment housing in the three dimensional space relative to the external housing of the grinding machine; a spindle rotatably mounted on said attachment housing; a driven pulley wheel fixedly mounted on said spindle to rotate with said spindle; a grinding abrasive element mounted on said spindle at a grinding station for rotation therewith; coupling means for mechanically coupling said pulleys to cause rotation of said driven pulley when the driving pulley is rotated by the grinding machine, said pulley wheels having different diameters, whereby actuation of the grinding machine causes said abrasive elements to only rotate relative to the external housing at a selected speed different from said predetermined rotational speed for precision grinding at the grinding station.

2. A grinder attachment as defined in claim 1, wherein said attachment housing at least partially conforms to the exterior shape of the grinding machine external housing.

3. A grinder attachment as defined in claim 1, wherein said driving pulley is mounted on said driven shaft for rotation in a first plane, said driven pulley being arranged for rotation on said spindle in said first plane.

4. A grinder attachment as defined in claim 1, wherein said driven pulley has a diameter smaller than the diameter of said driving pulley, whereby the attachment causes said grinding abrasive element to rotate at a speed higher than said predetermined rotational speed.

5. A grinder attachment as defined in claim 1, wherein said coupling means comprises a drive belt coupling said pulleys.

6. A grinder attachment as defined in claim 5, further comprising adjustable tensioning means for selectively adjusting the tension on said drive belt.

7. A grinder attachment as defined in claim 6, wherein said belt normally assumes a predetermined path between said pulleys, said adjustable tensioning means comprising a tensioning pulley the periphery of which can be selectively moved in relation to said predetermined path to selectively deflect said belt from said path to effectively tighten said belt and prevent slipping of said belt on said pulleys.

8. A grinder attachment as defined in claim 7, wherein said adjustable tensioning means comprises a tensioning bracket pivotably mounted on said attachment housing about a pivot axis substantially parallel to the machine axis, and a tensioning pulley rotatably mounted on said tensioning bracket, said tensioning bracket being mounted for movements between a first position where said tensioning pulley is out of contact with said belt and does not deflect said belt and a plurality of positions where said tensioning pulley contacts and variably deflects said belt.

9. A grinder attachment as defined in claim 8, wherein said tensioning bracket includes an adjustment slot and a fastener extending through said slot and mounted on said adjustment housing and being selectively movable to fix said tensioning bracket in any position of said fastener within said slot.

10. A grinder attachment as defined in claim 1, wherein said attachment housing is formed of a material which prevents deformations thereof during normal use of the attachment.

11. A grinder attachment as defined in claim 10, wherein said attachment is a housing made of steel.

12. A grinder attachment as defined in claim 10, wherein said attachment housing is dimensioned to prevent deformation thereof during normal use.

13. A grinder attachment as defined in claim 10, wherein said attachment housing is provided with rigidifying means for preventing deformation thereof during normal use.

14. A grinder attachment as defined in claim 1, further comprising a bearing for rotatably mounting said spindle on said attachment housing.

15. A grinder attachment as defined in claim 14, wherein said bearing maintains said spindle rotating about a generally stable axis of rotation.

16. A grinder attachment as defined in claim 15, wherein the maximum linear movements of said abrasive element on said spindle relative to the external housing and below 0.0005 in to 0.0007 in.

17. A grinder attachment as defined in claim 15, wherein the maximum angular movements of said abrasive element on said spindle relative to the external housing are below 0.0060° to 0.008°.

18. A grinder attachment for precision grinding with an existing grinding machine having an external housing and a driven shaft rotatable about a grinder machine axis at a predetermined rotational speed when energized, the attachment comprising a driving pulley wheel having a first diameter attachable on the driven shaft for rotation therewith about the machine axis; an attachment housing; attachment means for rigidly attaching said attachment housing to the external housing of the grinding machine to substantially prevent any movements of said attachment housing in the three dimensional space relative to the external housing of the grinding machine; a spindle rotatably mounted on said attachment housing; a driven pulley wheel fixedly mounted on said spindle to rotate with said spindle; a grinding abrasive element mounted on said spindle at a grinding station for rotation therewith; coupling means for mechanically coupling said pulleys to cause rotation of said driven pulley when the driving pulley is rotated by the grinding machine, said attachment housing including a portion that selectively clamps a first portion of the grinding machine external housing eliminating at least two degrees of freedom of movement within a plane normal to the grinding machine axis, said attachment means comprising a member that rigidly secures said attachment housing to a second portion of the grinding machine external housing against at least a third degree of movement along a direction substantially parallel to the grinding machine axis and said pulley wheels having different diameters, whereby actuation of the grinding machine causes said abrasive elements to only rotate relative to the external housing at a selected speed different from said predetermined rotational speed for precision grinding at the grinding station.

19. A grinder attachment as defined in claim 18, wherein said member comprises a stabilizer plate rigidly attached to both said attachment housing and the grinding machine external housing.

* * * * *